US010314411B2

(12) United States Patent
Leonard

(10) Patent No.: US 10,314,411 B2
(45) Date of Patent: Jun. 11, 2019

(54) REFRIGERATED MERCHANDISER WITH AIRFLOW SUPPORT SYSTEM

(71) Applicant: Hussmann Corporation, Bridgeton, MO (US)

(72) Inventor: Larry N. Leonard, Saint Peters, MO (US)

(73) Assignee: Hussmann Corporation, Bridgeton, MO (US)

( * ) Notice: Subject to any disclaimer, the term of this patent is extended or adjusted under 35 U.S.C. 154(b) by 118 days.

(21) Appl. No.: 15/164,414

(22) Filed: May 25, 2016

(65) Prior Publication Data

US 2017/0340140 A1 Nov. 30, 2017

(51) Int. Cl.
*A47F 3/04* (2006.01)
*F04D 29/54* (2006.01)

(52) U.S. Cl.
CPC ..... *A47F 3/0443* (2013.01); *A47F 3/0447* (2013.01); *A47F 3/0469* (2013.01); *F04D 29/545* (2013.01)

(58) Field of Classification Search
CPC .... F04D 29/545; F04D 19/002; A47F 3/0447; A47F 3/0469; A47F 3/0443; A47F 2003/046; A47F 3/0491; A47F 3/0482; A47F 5/103; F25D 2317/063; F25D 17/067; F25D 23/023; F25D 25/028
See application file for complete search history.

(56) References Cited

U.S. PATENT DOCUMENTS 2,594,066 A 4/1952 Pabst
2,836,039 A 5/1958 Weber
3,063,252 A 11/1962 Lamb
3,063,256 A 11/1962 Lamb
3,103,796 A 9/1963 Dickson et al.
3,125,864 A 3/1964 Ural
RE25,735 E * 3/1965 Lamb ..... A47F 3/0447 62/234
3,186,185 A 6/1965 Bently et al.
3,218,822 A 11/1965 Bently et al.
3,289,432 A 12/1966 Brennan et al.
(Continued)

FOREIGN PATENT DOCUMENTS

EP 0600845 6/1994
JP 2012-105863 6/2012

OTHER PUBLICATIONS

PCT/US2017/029626 International Search Report and Written Opinion of the International Searching Authority dated Jul. 25, 2017 (15 pages).

(Continued)

*Primary Examiner* — Frantz F Jules
*Assistant Examiner* — Martha Tadesse
(74) *Attorney, Agent, or Firm* — Michael Best & Friedrich LLP

(57) ABSTRACT

A refrigerated merchandiser includes a case having a lower wall, an upper wall, a rear wall, and a rear panel. A product support area is at least partially defined by the lower wall, the upper wall, and the rear panel. A first air passageway is formed in the case for supplying refrigerated air to the product support area. A fan is positioned in the first air passageway for creating airflow. An evaporator coil is disposed in the air passageway to condition the airflow. A duct is coupled to the rear panel to create a second air passageway.

14 Claims, 8 Drawing Sheets

(56) References Cited

U.S. PATENT DOCUMENTS

| | | | | |
|---|---|---|---|---|
| 3,304,736 | A | 2/1967 | Brennan et al. | |
| 3,306,068 | A | 2/1967 | Allgeyer et al. | |
| 3,324,676 | A | 6/1967 | Gerweck | |
| 3,365,907 | A | 1/1968 | Barroero | |
| 3,369,375 | A | 2/1968 | Gerweck et al. | |
| 3,690,118 | A | 9/1972 | Rainwater | |
| 3,696,630 | A | 10/1972 | Bressickello | |
| 3,756,038 | A | 9/1973 | MacMaster et al. | |
| 3,827,254 | A | 8/1974 | MacMaster et al. | |
| 4,314,458 | A | 2/1982 | Hade et al. | |
| 4,325,227 | A * | 4/1982 | Ibrahim | A47F 3/0408 62/248 |
| 4,760,708 | A | 8/1988 | Karashima | |
| 4,938,034 | A | 7/1990 | Rosanio et al. | |
| 5,345,778 | A | 9/1994 | Roberts | |
| 5,755,108 | A | 5/1998 | Ibrahim et al. | |
| 6,539,741 | B2 | 4/2003 | Navarro | |
| 7,062,932 | B2 | 6/2006 | Downs | |
| 7,540,162 | B2 | 6/2009 | Nordstrom | |
| 8,359,876 | B2 | 1/2013 | Esformes | |
| 8,647,183 | B2 | 2/2014 | Swofford | |
| 9,084,496 | B1 * | 7/2015 | Neelagantan | A47F 3/0482 |
| 2001/0003248 | A1 | 6/2001 | Otto et al. | |
| 2004/0163401 | A1 | 8/2004 | Alahyari et al. | |
| 2006/0005567 | A1 * | 1/2006 | Lee | F25D 17/045 62/408 |
| 2006/0042288 | A1 * | 3/2006 | Downs | A47F 3/0447 62/256 |
| 2010/0024446 | A1 | 2/2010 | Rohrer et al. | |
| 2013/0319030 | A1 * | 12/2013 | Nguyen | A47F 3/0447 62/256 |
| 2013/0327070 | A1 * | 12/2013 | Rees | F25D 21/04 62/80 |
| 2015/0297000 | A1 * | 10/2015 | Gomes | A47F 3/0447 62/255 |
| 2017/0280896 | A1 * | 10/2017 | Watanabe | A47F 3/0447 |
| 2017/0292770 | A1 * | 10/2017 | Fowler | A47F 3/0447 |

OTHER PUBLICATIONS

Amin, M. et al., "Comprehensive study on the effects of fluid dynamics of air curtain and geonmetry, on infiltration rate of open refrigerated cavities," Applied Thermal Engineering 31 (2011) pp. 3055-3065.

* cited by examiner

REFRIGERATED MERCHANDISER WITH AIRFLOW SUPPORT SYSTEM

BACKGROUND

The present application relates to refrigerated merchandisers and, more particularly, to conditioning product display areas of refrigerated merchandisers.

In conventional practice, supermarkets and convenience stores are equipped with refrigerated merchandisers, which may be open or provided with doors, for presenting fresh food or beverages to customers while maintaining the fresh food and beverages in a refrigerated environment. Typically, refrigerated air is provided to a product display area of the merchandiser by passing airflow over the heat exchange surface of an evaporator. A refrigerant passes through the evaporator and heat is absorbed from the air passing through the evaporator. As a result, the temperature of the air passing through the evaporator is lowered for introduction into the product display area of the merchandiser.

SUMMARY

According to an exemplary embodiment, a refrigerated merchandiser includes a case having a lower wall, an upper wall, a rear wall, and a rear panel spaced from the rear wall. The lower wall, the upper wall, and the rear panel at least partially define a product support area. The case further defines a first air passageway in fluid communication with the product support area. The first air passageway has a vertical portion disposed between the rear wall and the rear panel. A fan is positioned in the first air passageway and is configured to generate an airflow through the first air passageway and into the product support area. An evaporator is disposed in the first air passageway and configured to condition the airflow. A duct is disposed between the rear wall and the rear panel. The rear panel and the duct cooperatively defining a second air passageway. The duct is positioned to overhang a portion of the evaporator to receive air directly from the evaporator. The first air passageway is configured to direct conditioned air to the product support area. The rear panel includes apertures configured to provide fluid communication between the second air passageway and the product support area. The second air passageway is configured to direct conditioned air to the product support area separate from the first air passageway.

According to another exemplary embodiment, a refrigerated merchandiser includes a case having a lower wall, an upper wall, a rear wall, and a rear panel spaced from the rear wall. The lower wall, the upper wall, and the rear panel at least partially defining a product support area. The case further defines a first air passageway in fluid communication with the product support area. The first air passageway has a vertical portion disposed between the rear wall and the rear panel. A fan is positioned in the first air passageway and configured to generate an airflow through the first air passageway and into the product support area. An evaporator is disposed in the first air passageway and configured to condition the airflow. The rear panel includes an aperture defined by an extruded projection extending into the product support area.

According to another exemplary embodiment, a refrigerated merchandiser includes a case having a canopy, a base, and a rear wall. A product support area at least partially defined by the lower wall and the upper wall. An upper flue at least partially defined by the canopy, a lower flue at least partially defined by the base, and a rear flue at least partially defined by the rear wall. The upper flue, lower flue, and rear flue defining an air passageway. An outlet defined by the canopy is configured to provide fluid communication between the air passageway and the product support area forming an air curtain. A fan is positioned in the first air passageway and configured to generate an airflow through the first air passageway and into the product support area. An evaporator is disposed in the first air passageway and configured to condition the airflow. The case includes a rear panel disposed between the rear flue and the product support area. The rear panel has an aperture defined by a nozzle configured to direct air generally horizontally toward the air curtain.

BRIEF DESCRIPTION OF THE DRAWINGS

The aspects and features of various exemplary embodiments will be more apparent from the description of those exemplary embodiments taken with reference to the accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
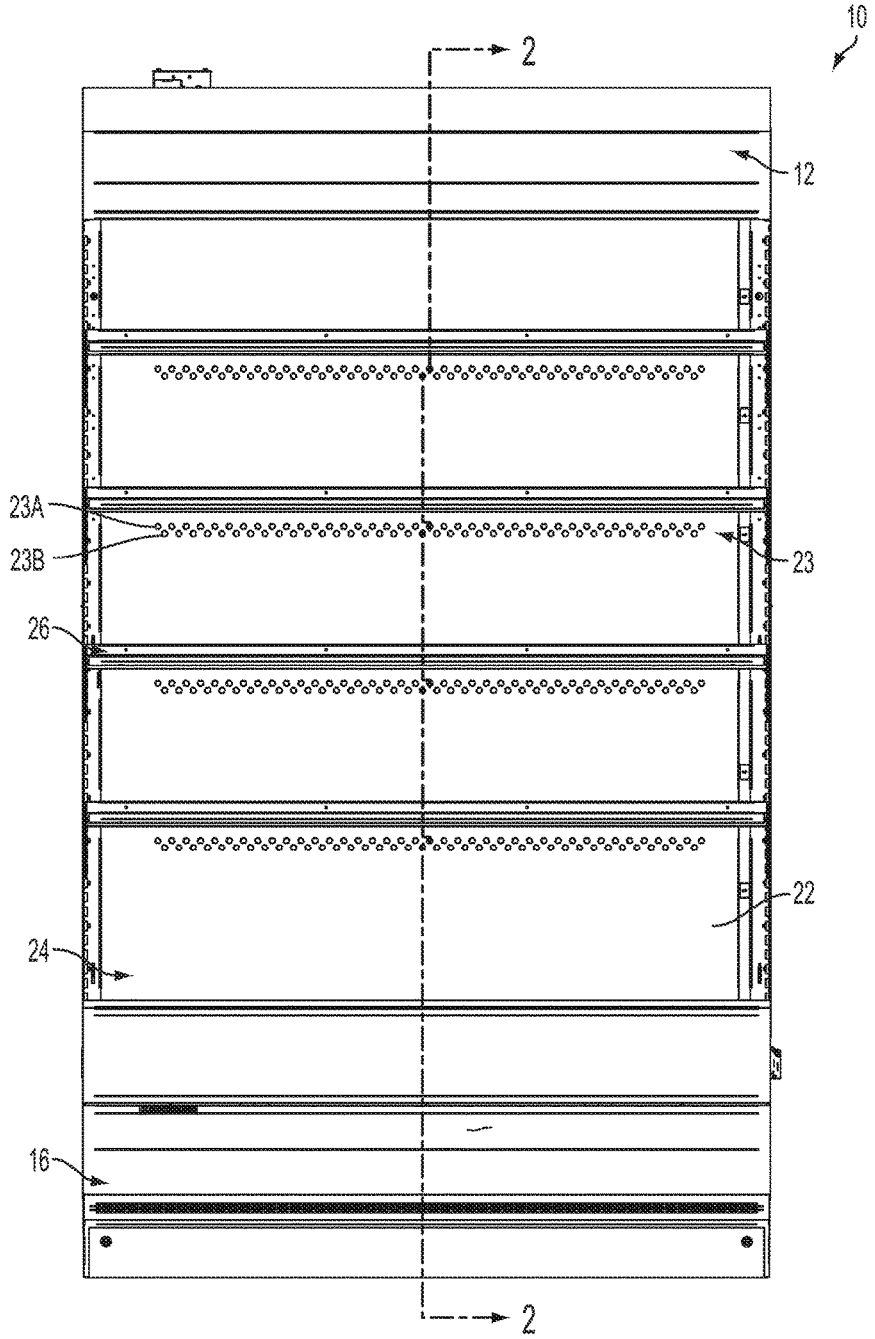
FIG. 1 is a front view of an exemplary refrigerated merchandiser including shelves and embodying the invention.
Figure 2:
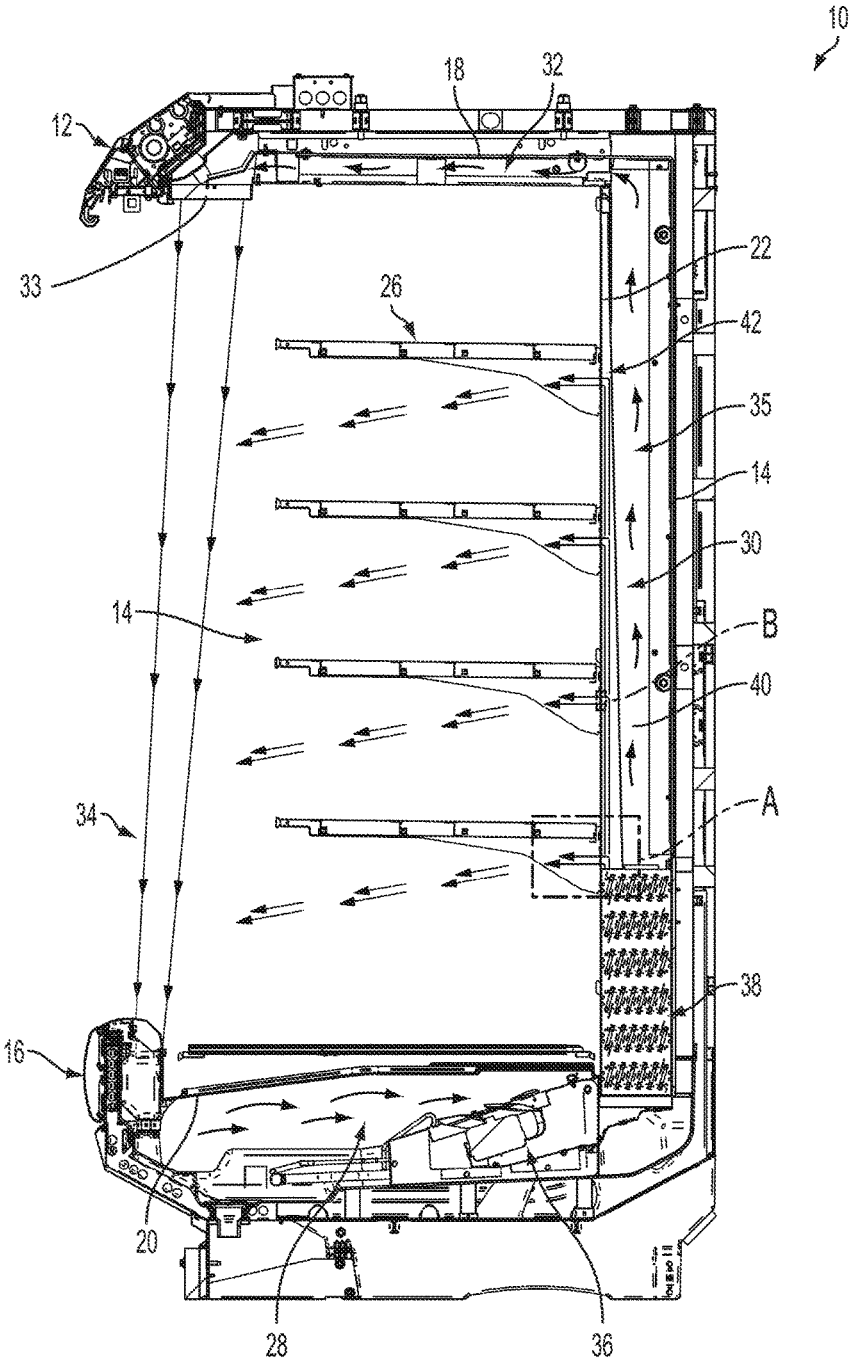
FIG. 2 is a section view of the merchandiser of FIG. 1 taken along line 2-2 and illustrating a rear panel defining a product support area, as well as an airflow passageway and an air duct disposed behind the rear panel.
Figure 3:
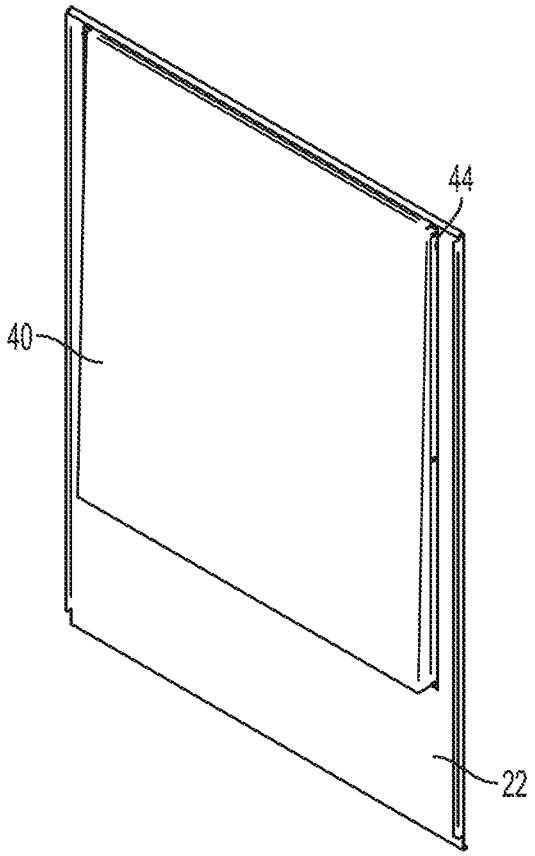
FIG. 3 is a rear perspective view of the rear panel and duct.

FIGS. 1 and 2 illustrate an exemplary embodiment of a refrigerated merchandiser 10 that may be configured as a low temperature merchandiser or a medium temperature merchandiser. The merchandiser 10 can include one or more interconnected case sections that may have respective refrigeration components (e.g., evaporator, expansion valve, etc.) of a refrigeration system, or that may share one or more refrigeration components of the refrigeration system.

With reference to FIGS. 1 and 2, the merchandiser 10 includes a case that has a canopy 12, a rear wall 14, and a base 16. The canopy 12 and the base 16 are spaced from one another to at least partially define a case opening. The canopy 12 includes an upper wall 18 facing the interior of the merchandiser 10 and the base 16 includes a lower wall 20 facing the interior of the merchandiser 10 opposite the upper wall 18.

Figure 4:
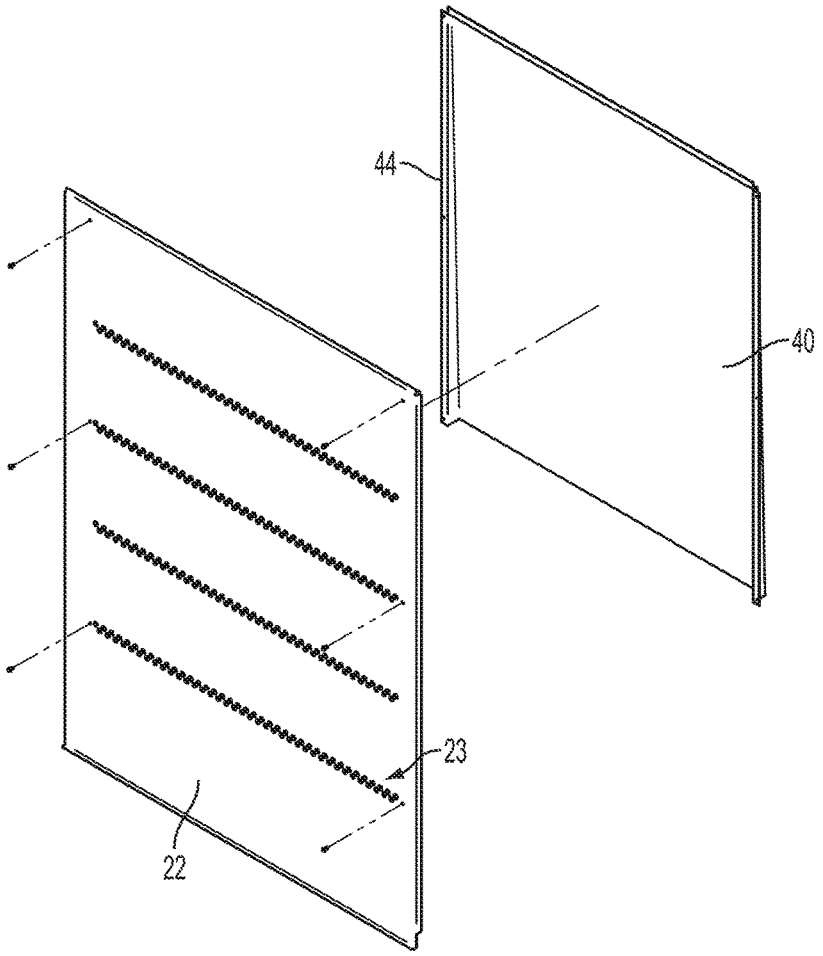
FIG. 4 is a front, exploded perspective view of the rear panel and the duct of FIG. 3.

The merchandiser 10 also includes a rear panel 22 that is is positioned interior of the rear wall 14. The rear panel 22 includes one or more apertures 23 or one or more sets of apertures 23 that provide fluid communication through the rear panel 22. As shown in FIGS. 1 and 4, the rear panel 22 includes four sets of apertures 23, although fewer or additional sets of apertures can be provided. Each set of apertures 23 includes a first row of apertures 23A and a second row of apertures 23B that are spaced in close, vertical proximity to each other. As illustrated in FIG. 1, the first row of apertures 23 is offset from the second row of apertures 23 in the horizontal direction, although the apertures 23 in each set can be vertically aligned (i.e. not offset in the horizontal direction).

The area bounded by the lower wall 20, the upper wall 18, and the rear panel 22 at least partially defines a product support area 24. One or more shelves 26 extend from the rear panel 22 into the product support area 24 to display and support products.

The merchandiser 10 has a lower flue 28 that is at least partially defined by the base 16 and that is in fluid communication with a rear flue 30 at least partially defined by the rear wall 14. The lower flue 28 is positioned below the lower wall 20 and is in fluid communication with the product support area adjacent the case opening such that air can be drawn into the flue 28 from the product support area 24. The rear flue 30 is in fluid communication with an upper flue 32 at least partially defined by the canopy 12. The rear flue 30 is oriented to redirect the airflow from the lower flue 28 into a substantially vertical airflow through the merchandiser 10.

The upper flue 32 is positioned above the upper wall 18 and is oriented to redirect the vertical airflow in the rear flue 30 into a horizontal airflow that is directed toward an outlet 33 in the canopy 12. The outlet can include one or more openings, and a louver (not shown) can be positioned over the outlet to define an airflow profile for air that is directed generally downward across or in front of the product support area 24 to generate a front air curtain 34.

The merchandiser 10 also includes a refrigeration system (not entirely shown) that conditions the airflow directed into the product support area 24 to cool product located in the product support area 24. As shown in FIG. 2, the refrigeration system includes one or more fans 36 (one shown) and an evaporator 38. As illustrated, the fan 36 is positioned in the lower flue 28 and is configured to generate an airflow. The evaporator 38 shown in FIG. 2 is positioned in the rear flue 30 downstream of the fan 36. As will be appreciated, the evaporator 38 may be positioned upstream of the fan 36 such that the fan 36 draws air through the evaporator 38. Other components associated with the refrigeration system, including sensors and controllers can be provided with the merchandiser 10 or remote from the merchandiser 10 to monitor and control the refrigeration system. As will be appreciated by one of ordinary skill in the art, the types of and locations for refrigeration system components can be varied.

As shown in FIGS. 2 and 3-5, the merchandiser 10 includes a duct 40 that is disposed n the rear flue and that has an outer flange 44 coupled to the rear panel 22. The flange 44 extends along the sides and the top of the rear panel 22, either continuously or discretely. With reference to FIG. 4, the illustrated duct 40 and the rear panel 22 are formed as separate pieces that are attached to each other (e.g., via fasteners or other attachment features such as welding, brazing, adhesion, etc.). In some embodiments, the rear panel 22 and duct 40 can be formed together as a unitary structure or each component can be formed from multiple pieces and joined together or otherwise coupled.

The lower flue 28, the void in the rear flue 30 between the rear wall 14 and the duct 40, and the upper flue 32 cooperatively define a first air passageway 35. As shown in FIGS. 2 and 3-5, the lower flue 28 and the duct 40 cooperatively define a second air passageway 42. Air is configured to flow through the evaporator 38 into the second air passageway 42 substantially parallel to the airflow in the first air passageway 35 within the rear flue 30. As shown in FIG. 6, the duct 40 overhangs at least a portion of the evaporator 38. The duct 40 can be positioned adjacent or in contact with the evaporator 38 so that it receives air substantially directly from the evaporator 38. For example, air leaving the portion of the evaporator 38 that is directly beneath the duct 40 may only flow into the second air passageway 42 without entering the remainder of the first air passageway 35 upstream of the inlet to the duct 40. As a result, air leaving the evaporator 38 can be divided upstream of the evaporator into a first portion that flows through the first air passageway 35 and a second portion that flows through the second air passageway 42.

Figure 5:
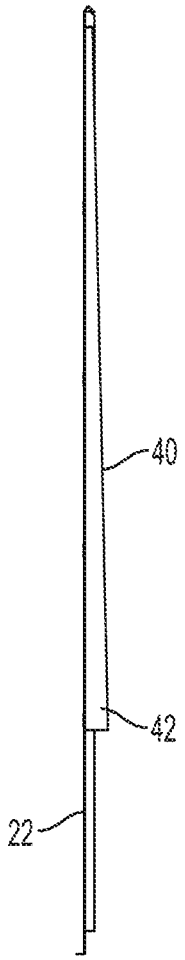
FIG. 5 is a view of the rear panel and the duct of FIG. 3.
Figure 6:
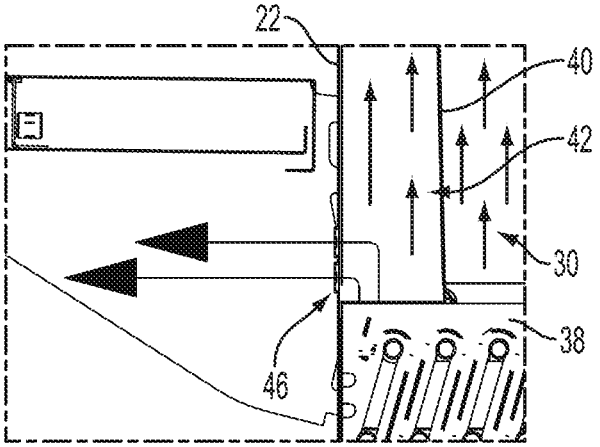
FIG. 6 is an enlarged view of detail A of FIG. 2.
Figure 10:
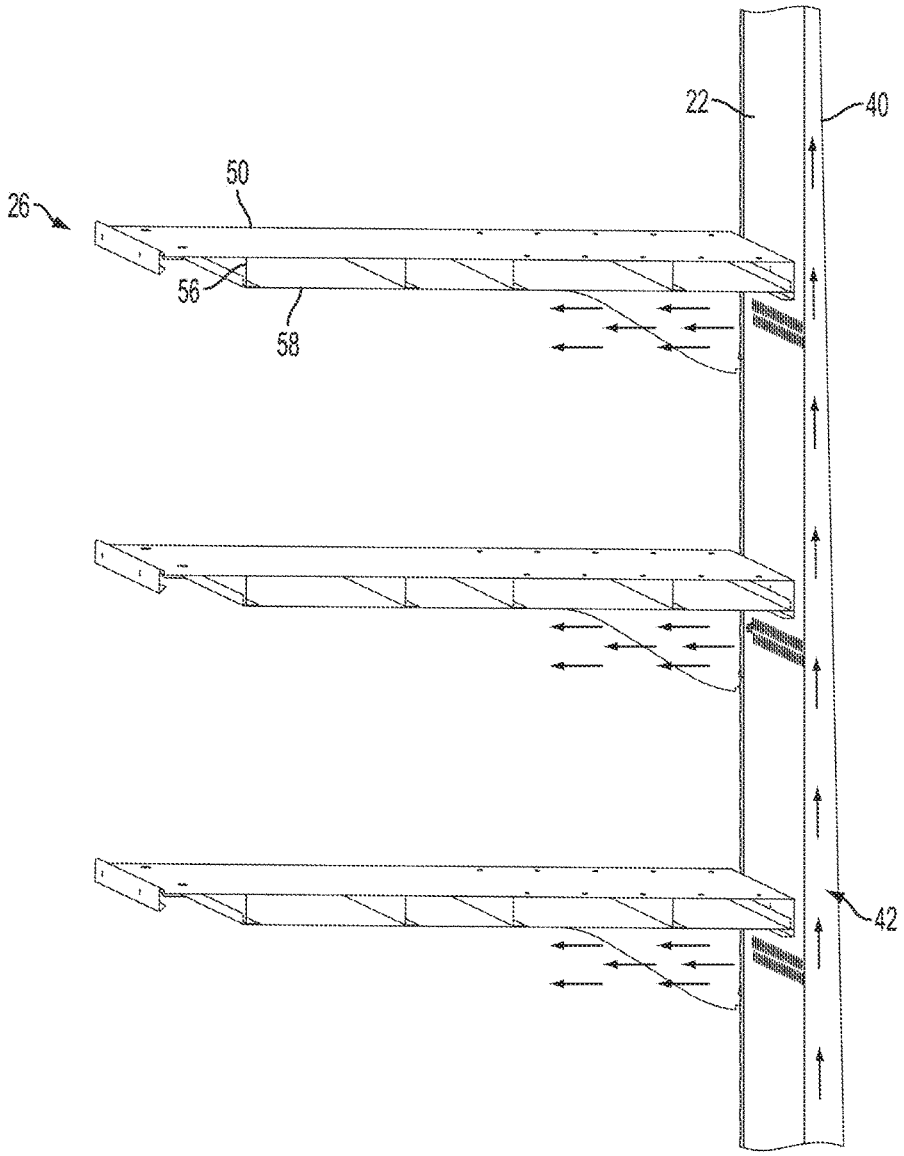
FIG. 10 is a perspective section view of a portion of the merchandiser and illustrating the rear panel, the duct, and shelves of the merchandiser, as well as airflow into the product support area.

With reference to FIGS. 5 and 10, the portion of the second air passageway 42 defined by the duct 40 tapers from a lower portion to an upper portion of the panel 22. Stated another way, the second air passageway 42 has, in cross section, a throat width dimension that is greater adjacent the evaporator coil 38 than adjacent the canopy 12 such that the volume of the second air passageway 42 is reduced in a vertical direction (upward as illustrated in FIG. 2). The tapered configuration of the second air passageway 42 maintains a steady airflow through the second air passageway 42, even as air leaves through the apertures 23. The tapered shape defined by the duct 40 provides a substantially constant airflow rate from the bottom to the top of the second air passageway 42 within the duct 40. It will be appreciated that the length of the duct 40, the quantity of apertures 23, or the arrangement of the apertures 23 (e.g., spacing, size, pattern, or configuration), or any combination of these features can differ depending on desired fluid and thermal characteristics of the merchandiser 10.

Figure 7:
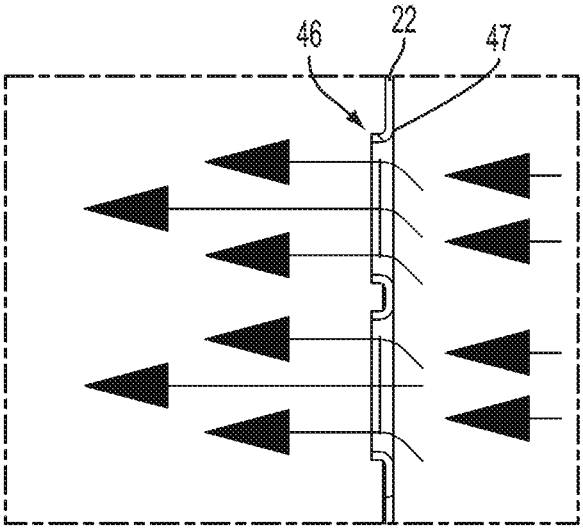
FIG. 7 is an enlarged view of detail B of FIG. 2.

With reference to FIG. 7, the apertures 23 are defined by nozzles 46 that project or extend into the product support area 24 to direct air from the second air passageway 42 into the product support area 24. The term 'nozzle', as described and claimed, refers to structure that directs or diverts airflow apart from a plain opening or hole formed in a panel. The exemplary nozzles 46 have a substantially cylindrical configuration with a fillet or rounded transition 47 between a planar surface of the rear panel 22 and the end of the nozzle 46. The nozzles 46 can be formed in the rear panel 22 via an extrusion process or another process that produces nozzles 46 extending from the rear panel 22 into the product support area 24. In some embodiments, the nozzles 46 and the rear panel 22 may be formed separately and joined or connected together. The size, shape, configuration, and orientation of the nozzles 46 can also be altered from what is illustrated.

Unlike typical openings that can cause air to exit in a non-uniform manner, creating turbulence, the nozzles 46 control the airflow through the rear panel 22. The illustrated nozzles 46 redirect and straighten at least a portion of the airflow from the second air passageway 42 as the air passes through the rear panel 22. In some embodiments, the nozzles 46 reduce or eliminate turbulence and provide substantially uniform, horizontal airflow through the nozzle 46 and into the product support area 14. The airflow from the nozzles 46 can help support the front air curtain 34. For example. The airflow through the nozzles 46 can provide air to the front of the case that supports the thermal barrier between the case and the ambient environment, without breaking or disrupting the front air curtain 34.

Figure 8:
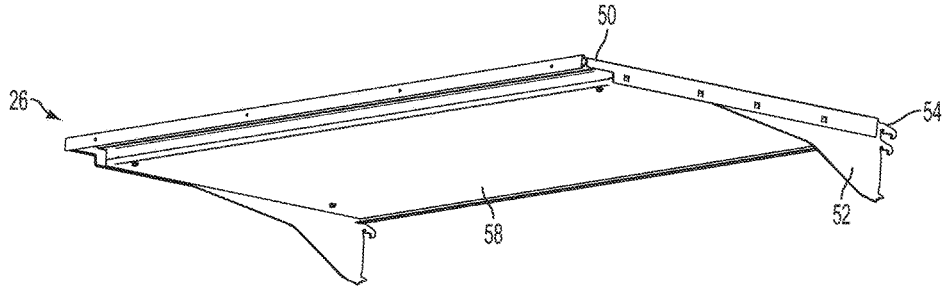
FIG. 8 is a bottom perspective view of one of the shelves of the merchandiser illustrated in FIGS. 1 and 2.
Figure 9:
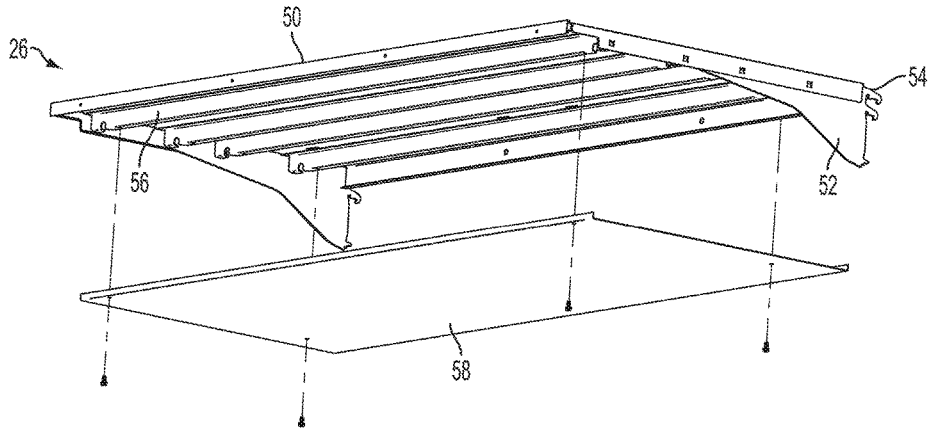
FIG. 9 is an exploded view of the shelf of FIG. 8.

With reference to FIGS. 1, 2, and 10, each set of apertures 23 is positioned below a respective shelf 26. FIGS. 8 and 9 show an exemplary shelf 26 that has an upper surface 50 for supporting a product and a pair of side brackets 52. The side brackets 52 include one or more arms 54 that extend into slots formed in the rear panel 22 to releasably connect the shelf 26 to the case. One or more sets of apertures 23 can be positioned in or bounded by an area at least partially defined by the side brackets 52. For example, the illustrated apertures 23 are horizontally positioned between the side brackets 52 and vertically positioned between a lower edge of the side brackets 52 and the upper surface 50 of the shelf 12. As shown in FIG. 9, the shelf 26 can include one or more support brackets 56 formed integrally with, or connected to, an underside of the shelf 26.

As illustrated in FIGS. 8 and 9, a cover plate 58 is connected to a lower side of the shelf 26. The cover plate 58 has a smooth, planar bottom surface (as viewed in FIG. 9), a front lip, and a rear lip. Fasteners (e.g., screws) can be used to attach the cover plate 58 to the shelf 12, or the cover plate 58 can be adhered, welded, fused, or attached to the shelf 12 in other ways (e.g., snap-fit, friction-fit, etc.). The cover plate 58 overlays the lower side of the shelf 26 and encloses the support brackets 56 to provide a smooth surface along which the airflow passes toward the front of the product support area 24 after discharge through the apertures 23.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. For example, although the invention is described and illustrated herein with reference to an open-front, vertically-oriented merchandiser, other types of merchandisers or display cases can utilize aspects of the invention described, illustrated, and recited herein. Also, any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

The invention claimed is:

1. A refrigerated merchandiser comprising:

a case including a lower wall, an upper wall, a rear wall, and a rear panel spaced from the rear wall, the lower wall, the upper wall, and the rear panel at least partially defining a product support area, the case further defining a first air passageway in fluid communication with the product support area, the first air passageway having a vertical portion disposed between the rear wall and the rear panel;

a fan positioned in the first air passageway and configured to generate an airflow through the first air passageway and into the product support area;

an evaporator disposed in the first air passageway and configured to condition the airflow; and a duct disposed between the rear wall and the rear panel and coupled to the rear panel, the rear panel and the duct cooperatively defining a second air passageway, the duct positioned to overhang a portion of the evaporator to receive air directly from the evaporator, wherein the first air passageway is configured to direct conditioned air to the product support area, wherein the rear panel includes apertures configured to provide fluid communication between the second air passageway and the product support area, wherein the second air passageway is configured to direct the conditioned air to the product support area separate from the first air passageway, and wherein the duct is tapered as the duct extends along the rear panel away from the evaporator and configured to provide a substantially uniform airflow to the apertures.

2. The refrigerated merchandiser of claim 1, wherein the second air passageway is positioned over the evaporator such that the conditioned air is only directed upward toward the apertures.

3. The refrigerated merchandiser of claim 1, further comprising shelves coupled to the rear panel and extending into the product support area, wherein each row of the apertures is arranged on the rear panel directly below the shelves.

4. The refrigerated merchandiser of claim 1, wherein the apertures are defined by nozzles.

5. The refrigerated merchandiser of claim 4, wherein each of the nozzles include a projection extending into the product support area and a rounded transition.

6. The refrigerated merchandiser of claim 4, wherein a shelf is coupled to and extends from the rear panel over the apertures, the refrigerated merchandiser further comprising a cover plate coupled to a bottom of the shelf, wherein the cover plate has a planar surface exposed to the product support area.

7. The refrigerated merchandiser of claim 4, wherein the nozzles straighten at least a portion of the airflow through the rear panel.

8. The refrigerated merchandiser of claim 1, wherein the apertures included a first row of apertures extending horizontally across the rear panel and a second row of apertures is positioned above the first row of apertures and offset from the first row of apertures in a vertical direction.

9. The refrigerated merchandiser of claim 8, further comprising a shelf including an upper surface, a first bracket, and a second bracket coupled to the rear panel, wherein the first and second rows of apertures are disposed in a region at least partially defined by the shelf.

10. The refrigerated merchandiser of claim 4, wherein the rear panel includes a planar section and the nozzles project from the planar portion toward the product support area.

11. The refrigerated merchandiser of claim 10, wherein the interior of the nozzles include a rounded transition adjacent the planar portion.

12. The refrigerated merchandiser of claim 4, wherein the nozzles have a cylindrical opening exposed to the product support area.

13. The refrigerated merchandiser of claim 4, further comprising a shelf disposed over the nozzles and including an upper portion, a lower portion and a cover plate coupled to the lower portion and defining a planar lower surface of the shelf to minimize turbulence in a flow of air traveling from the nozzles toward an air curtain.

14. The refrigerated merchandiser of claim 13, wherein the cover plate includes a planar surface.

* * * * *